United States Patent [19]

Modeen

[11] 4,068,448

[45] Jan. 17, 1978

[54] SMALL ARTICLE PACKAGING APPARATUS

[75] Inventor: Marvin O. Modeen, Columbus, Ohio

[73] Assignee: IN-Pac Corporation, Columbus, Ohio

[21] Appl. No.: 712,687

[22] Filed: Aug. 9, 1976

[51] Int. Cl.[2] ..... B65B 5/02; B65B 11/50; B65B 61/26

[52] U.S. Cl. ..... 53/131; 53/184 R

[58] Field of Search ..... 53/30 R, 112 A, 131, 53/184 R, 282, 329

[56] References Cited

U.S. PATENT DOCUMENTS

| | | | |
|---|---|---|---|
| 3,000,157 | 9/1961 | Ollier et al. | 53/184 |
| 3,347,011 | 10/1967 | Lovas et al. | 53/184 |
| 3,354,611 | 11/1967 | Powell | 53/184 |
| 3,464,182 | 9/1969 | Nichols | 53/184 |
| 3,487,622 | 1/1970 | Mueller | 53/282 |
| 3,503,182 | 3/1970 | Phipps | 53/282 |
| 3,874,143 | 4/1975 | Braber | 53/184 X |
| 4,012,888 | 3/1977 | Nichols | 53/131 |

*Primary Examiner*—Robert Louis Spruill

[57] ABSTRACT

A small article packaging apparatus is provided and comprises a housing which is subdivided into six separate working areas. An elongated conveyor strip is fed sequentially through each of the six working areas while an elongated closure strip is fed through and covers the conveyor strip in the final three working areas. The first working area includes labeling means for imprinting desired indicia on the conveyor strip while indentation means at the second work area forms an indentation in the conveyor strip. The desired small article or articles are placed within the indentations formed in the conveyor strip at the third working area while the fourth working area includes means for sealing the conveyor strip to the closure strip in a closed loop encircling the indentation in the conveyor strip. The fifth working area includes means for simultaneously incrementally advancing the joined conveyor and closure strips through the respective work areas. The last work area includes means for cutting the joined conveyor and closure strip between adjacent indentations thereby forming individual packages from the conveyor and closure strips. The labeling, indenting, sealing, and cutting means are synchronized in their operation while the advancing means is asynchronous with these aforementioned means.

5 Claims, 20 Drawing Figures

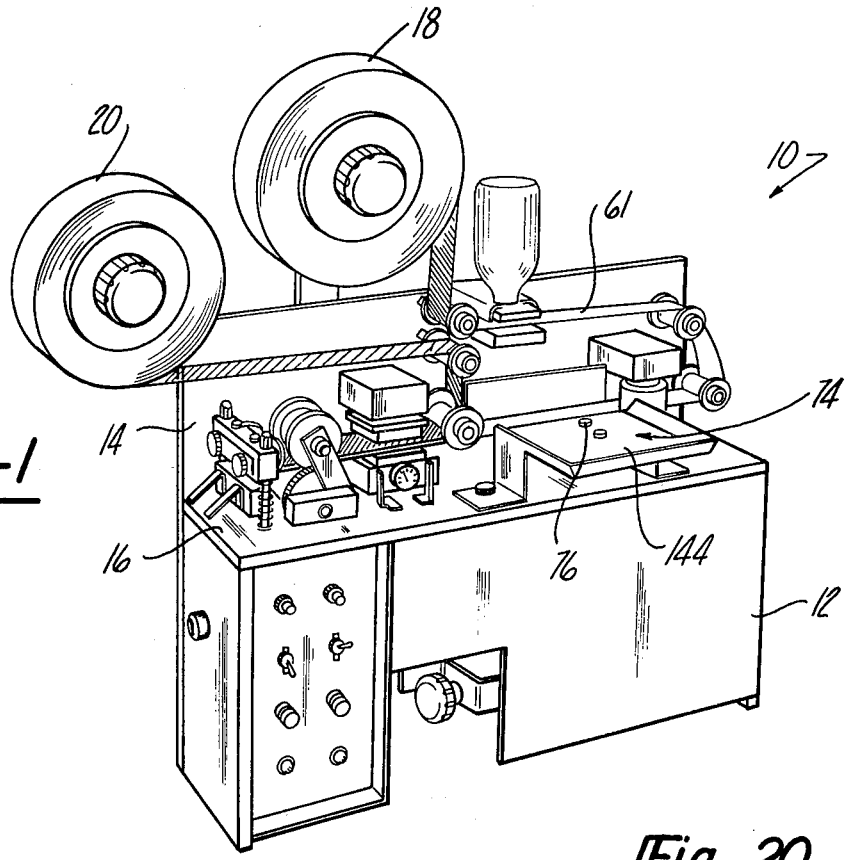
Fig-1
Fig-20
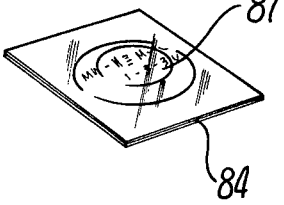
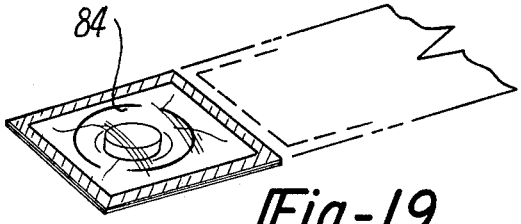
Fig-19
Fig-9
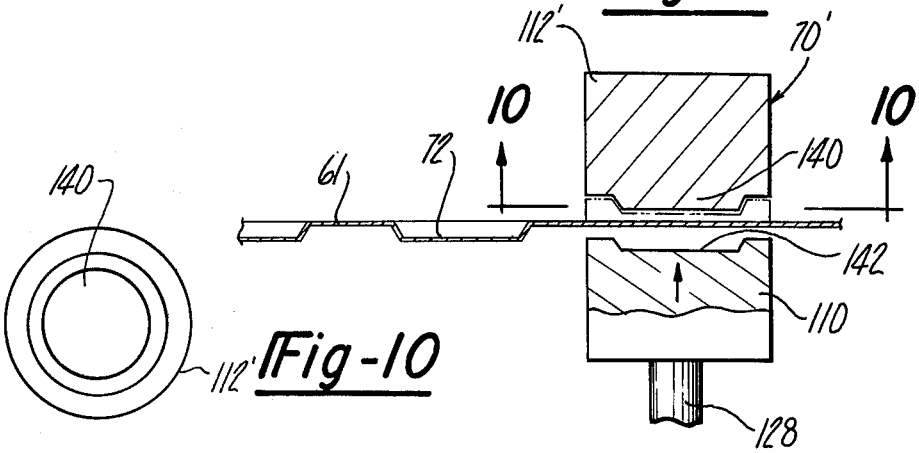
Fig-10

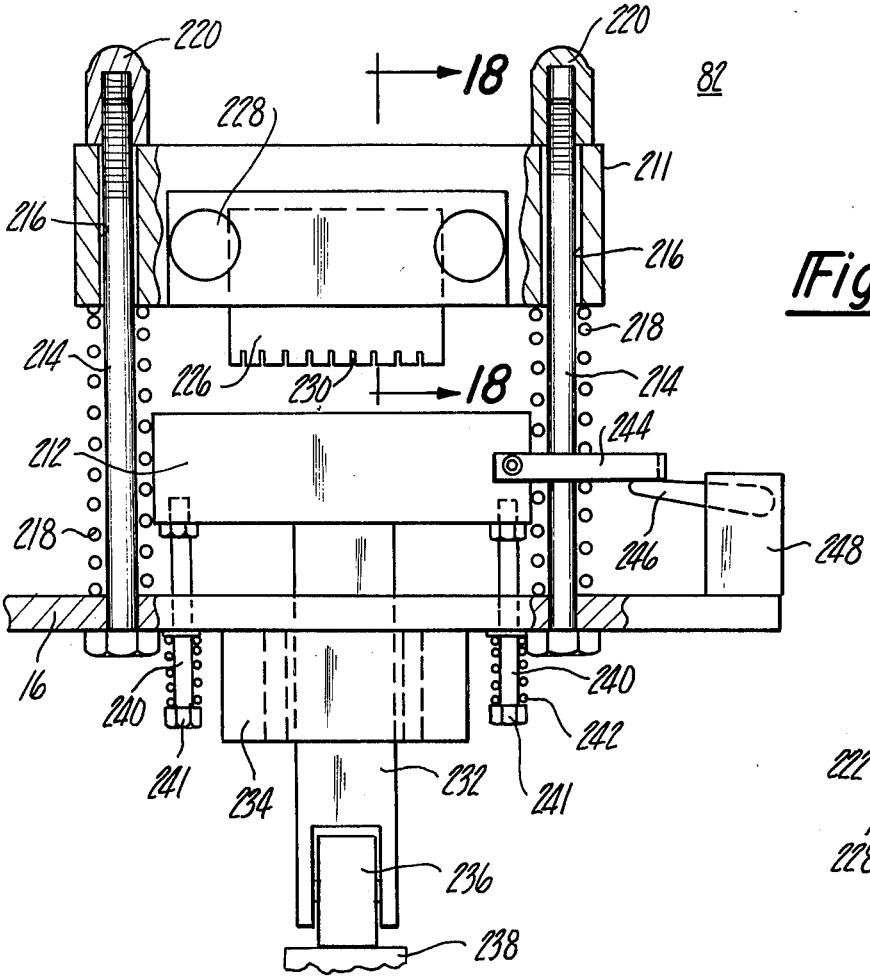
Fig-17
Fig-18
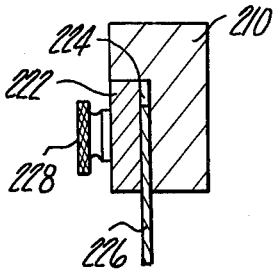
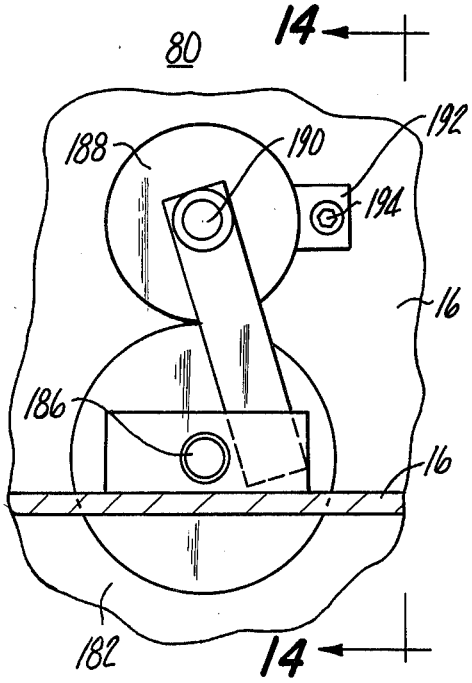
Fig-13
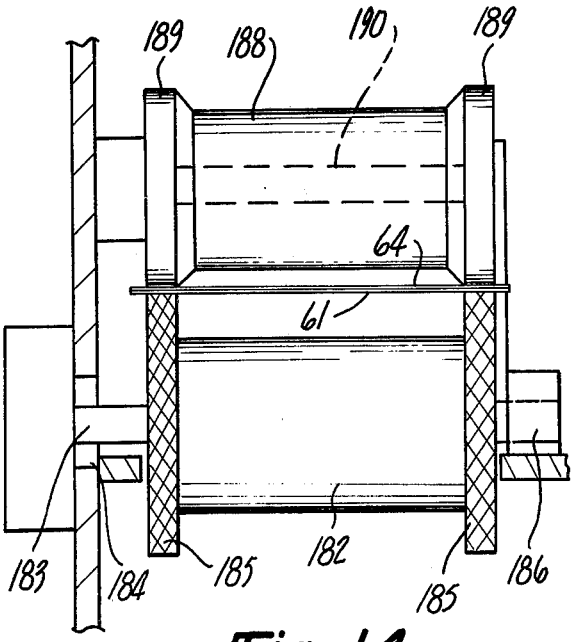
Fig-14

SMALL ARTICLE PACKAGING APPARATUS

BACKGROUND OF THE INVENTION

I. Field of the Invention

The present invention relates generally to small article packaging devices and, more particularly, to such a device in which the conveyor strip forms a part of the final package.

II. Description of the Prior Art

There have been many previously known small article packaging devices. While these prior devices can be utilized to package any desired small article, such devices have particular utility for packaging pills and other medicines. Such medicines are typically packaged in the unit doses for easy, accurate and simple disbursement in hospitals and medical clinics.

Although these previously known machines vary in form, typically they comprise a conveyor system which carries a first strip of the packaging material. The articles packaged by these prior devices are arranged by a feeder on the packaging material and thereafter the packaging material is sealed either to itself or to another strip of packaging material which encloses the article in the material. The conveyor system then moves the sealed articles to a cutting apparatus which severs the strip into packages, each containing the desired number of articles.

These previously known packaging machines suffer several disadvantages unknown to the present invention. One such disadvantage is that these previous machines are unduly complex and, accordingly, expensive in construction. In particular, the previously known feeders for loading the articles onto the conveyor material oftentimes jams up or otherwise malfunctions which renders the entire machine inoperable.

The conveyor for carrying the packaging strip is also an expensive component in these prior devices. Moreover, these conveyors require extensive periodic maintenance which also necessitates a shut down of the packaging device.

Another disadvantage of these previously known packaging achines is that the means for feeding the closure strip over the packaging strip must be precisely synchronized with the conveyor which carries the packaging strip. Oftentimes, either the conveyor or the means for feeding the closure strip over the packaging strip malfunctions which again necessitates shut down and repair of the packaging device.

Present "unit dose packaging" of pills and capsules for patient use in hospitals takes two forms. The first, packaging of high volume drugs, is done by large packaging machines usually located in the plants of the drug manufacturer. The second, too small to justify packaging at the plant but large enough to justify special packaging at the hospital, is usually done by a mobile packaging unit which is delivered periodically to the hospital pharmacy. Typically, such a mobile unit might visit a hospital once every few months and package 50,000–100,000 pills. Typically this total might also include a few hundred unit doses of many little-used pills up to several thousand unit doses of other pills.

Several serious problems attend the use of such mobile units. First, there are the traveling expenses of the operator. Second, time considerations dictate that the packaging machine be built for high speed operation with the accompanying increased risk of malfunction. In fact, the machines presently being used require an operator with some skills in machine repair. A third problem is that each time a different pill is to be packaged, the machine, particularly the feed hopper, must be cleaned and the printing stencil must be changed. This leads to a considerable down-time of the machine during which a skilled machine operator is occupied with tasks which could easily be carried out by unskilled people.

SUMMARY OF THE PRESENT INVENTION

The present invention overcomes the above mentioned disadvantages of the previously known small article packaging devices by providing such a device in which the strip of packaging material itself forms its own conveyor. In addition, the previously known complex and expensive feeder can be eliminated and thereinstead a work area is provided for manually placing the articles upon the strip of packaging material.

In brief, the packaging device of the present invention comprises a housing adapted to rotatably carry two rolls of packaging material. The housing is divided into six working areas and one roll of packaging material, which forms the conveyor strip, is fed consecutively through each of the six working areas. The other roll of packaging material, which forms the closure strip, is fed through only the latter three working areas.

At the first working area a labeling device imprints suitable indicia upon the conveyor strip.

At the second working area a punch and die arrangement forms an indentation or impression in the conveyor strip.

The third working area is an article loading area whereby the article or articles are placed, preferably manually, within the indentations formed in the conveyor strip by the punch and die arrangement.

Sealing means are provided at the fourth working area for sealing the closure strip to the conveyor strip in a closed loop which encircles one indentation formed in the conveyor strip so that the article is entrapped between the conveyor and closure strip.

Advancing means at the fifth working area simultaneously and incrementally advances the joined closure and conveyor strips through the various work areas on the housing.

A cutting device at the sixth work area severs or perforates the joined closure and conveyor strips at each of the closed loops formed by the sealing means. In this manner individual packages are cut from the joined strips so that each package contains one indentation and one or more articles therein.

Although each of the operative devices at the work stations can be driven by any suitable means, such as by chain drives from one or more motors, I prefer to operate them by a single cam shaft so that the labeling, indenting, sealing, and cutting devices are synchronized in operation whereas the advancing means is precisely asynchronous with these other devices. As such, the labeling, indenting, sealing, and cutting means are inoperative while the advancing means incrementally moves the joined conveyor and closure strips. Conversely, the advancing means is inoperative while these other devices form their operative functions on the closure and/or conveyor strip.

It is a feature of the machine of the invention that it can be operated by unskilled labor, such as is represented by the usual hospital volunteer worker; that it requires only simple adjusting within the skills of such typical volunteer; that its simplicity and absence of the usual conveyor belt makes it easy to keep it contamination free and that a unique indentation in the "conveyor belt-packaging strip" coupled with the unique timing of events permits of manual loading of the pills into the indentations.

By utilizing the strip of packaging material as its own conveyor, the expense and maintenance required by the previously known conveyor systems, as well as the usual problem with contamination, is totally eliminated. In addition, the manual loading provision of the articles onto the conveyor strip eliminates the expense and frequent malfunction of the previously known article feeders.

BRIEF DESCRIPTION OF THE DRAWINGS

A better understanding of the present invention will be had upon reference to the following detailed description when read in conjunction with the accompanying drawing wherein like reference characters refer to like parts throughout the several views and in which:

FIG. 1 is a perspective view showing the packaging apparatus of the present invention;

FIG. 9 is a fragmentary cross-sectional view similar to FIG. 8 but showing a modification thereof;

FIG. 10 is a plan view taken substantially along line 10—10 in FIG. 9;

FIG. 13 is a fragmentary plan view showing yet another component of the packaging apparatus of the present invention and enlarged for clarity;

FIG. 14 is a fragmentary partial sectional view taken substantially along line 14—14 in FIG. 13;

FIG. 17 is a fragmentary partial sectional view illustrating yet another component of the packaging apparatus of the present invention;

FIG. 18 is a cross-sectional view taken substantially along line 18—18 in FIG. 17;

FIG. 19 is a perspective view illustrating an article packaged by the packaging apparatus of the present invention; and FIG. 20 is a perspective view similar to FIG. 19 but showing the reverse side of the packaged article.

DETAILED DESCRIPTION OF THE PRESENT INVENTION

Figure 2:
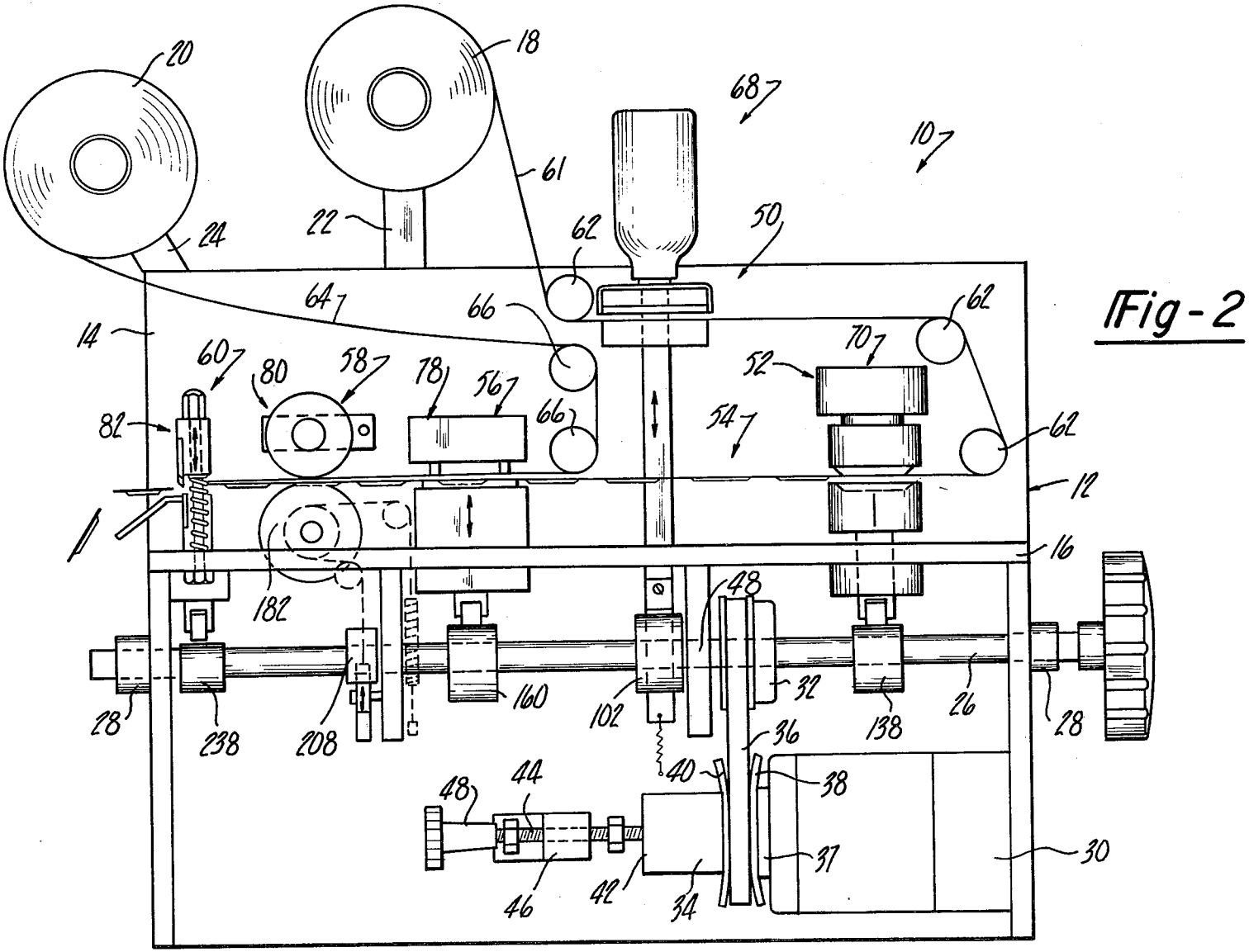
FIG. 2 is a front plan view of the packaging apparatus of the present invention and with parts removed for clarity.
Figure 3:
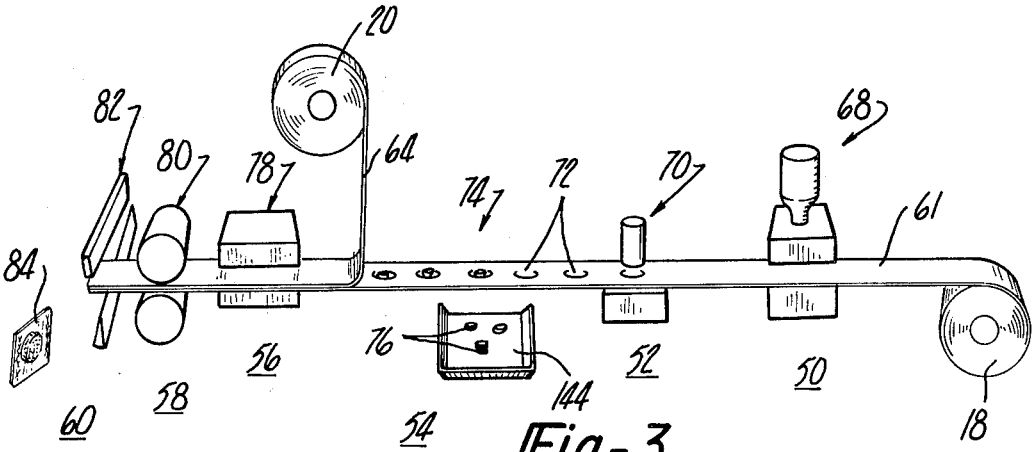
FIG. 3 is a diagrammatic view showing the operation of the packaging apparatus of the present invention.

With reference first to FIGS 1-3 the packaging apparatus 10 of the present invention is thereshown and includes a housing 12 having a back 14 and an elongated horizontal shelf 16 secured to the back 14. A first roll 18 and a second roll 20 of packaging material are rotatably supported by stands 22 and 24, respectively, secured to the back 14 of the housing 12.

The rolls 18 and 20 of packaging material are of conventional construction and typically comprise a synthetic fusible material such as polyethylene. The synthetic material, of course, can be laminated with a metallic foil or paper where desired. In any event the rolls 18 and 20 are adapted to unwind into elongated strips of packaging material as will be hereinafter described in greater detail.

As best shown in FIG. 2, a shaft 26 is rotatably mounted in bearings 28 within the housing 12 and generally parallel to the longitudinal length and underneath the shelf 16. A motor 30 is contained within the housing 12 and rotatably drives the shaft 26 by means of a pulley 32 secured to the shaft 26, a second pulley 34 secured to the motor 30, and a closed loop belt 36 which rotatably couples the pulley 32 and 34. Preferably the motor pulley 34 is of the variable drive type which includes a first member 37 having a concave plate 38 and secured to the motor shaft (not shown). The pulley 34 further includes a second member 42 having a concave plate 40 and coaxially disposed with the first member 37 so that the plates 38 and 40 are in a facing relationship. A threaded shaft 44 threadably engages a support 46 secured to the housing 12 and is attached to the member 42 at one end. Rotation of the shaft 44 by a knob 48 axially varies the distance between the concave plates 38 and 40 and thus varies the driving ratio between the pulleys 34 and 32 in the conventional fashion.

Still referring to FIGS. 1-3, for ease of description the housing 12 can be subdivided into six work stations 50, 52, 54, 56, 58 and 60 each of which will be hereinafter described in greater detail. The first roll of packaging material 18 forms an elongated conveyor strip 61 and is fed by rollers 62 sequentially through all six of the work stations 50-60. The second roll 20 of packaging material forms an elongated closure strip 64 and is fed by rollers 66 only through the final three work stations 50-60. In the arrangement described the rolls 18 and 20 need no adjusting mechanism except that they are under a small frictional resistance to prevent their unrolling unless being pulled by rotation of the spool 182.

The first work station includes labeling means 68 for imprinting desired indicia upon the conveyor strip 61.

The second work station 52 includes indenting means 70 for forming an indentation 72 in the conveyor strip 61.

The third work station 54 is a loading area 74 for placing small articles 76 within the indentations 72 formed by the indenting means 70.

The fourth work station 56 includes sealing means 78 which seals the closure strip 64 and the conveyor strip 61 together. Preferably, the sealing means 78 seals the strips 61 and 64 together in a close loop encircling at least one indentation 72.

The fifth work station 58 includes advancing means 80 for sequentially incrementally advancing the joined strips 61 and 64 through the other five work stations 50–56 and 60.

The sixth work station 60 includes cutting means 82 which severs the joined conveyor and closure strips 61 and 64, respectively, into individual packages 84 each including at least one of the indentations 72, and hence at least one of the articles 76. Alternatively, as will become hereinafter apparent, the cutting means 82 can be adapted for merely perforating, rather than cutting, the joined strips 61 and 64 where individual separated packages 84 are not desired.

As will later be described in detail, the labeling means 68, indenting means 70, sealing means 78 and cutting means 82 are all synchronized and perform their respective operation on the conveyor strip 61 or the joined conveyor and closure strips 61 and 64 substantially simultaneously. Conversely, the advancing means 80 is asynchronous with these other means 68, 70, 78, and 82 and advances the conveyor and closure only between these synchronized other operations.

With reference now to FIGS. 4–7, the labeling means 68 is there shown in greater detail and includes an inverted ink container 86 carried by a conventional stencil pad 88. Both the ink bottle 86 and the stencil pad 88 are of conventional construction and imprint indicia 87 (FIG. 20) contained on the stencil pad 88 (not shown) upon contact of the base 89 of the pad 88 with the conveyor strip 61. Preferably, the stencil pad 88 is easily interchangeable.

The stencil pad 88 and the ink container 86 are carried by a vertical elongated bar 90 which is vertically slidably mounted in a rectangular slot 91 formed through a support 92 secured to the housing back 14 and a registering rectangular slot 94 in the housing shelf 16. With this arrangement the stencil pad 88 is vertically movable in unison with the bar 90. If desired, any suitable means for changing the pressure of the container 86 against the pad 88 can be used.

Figure 4:
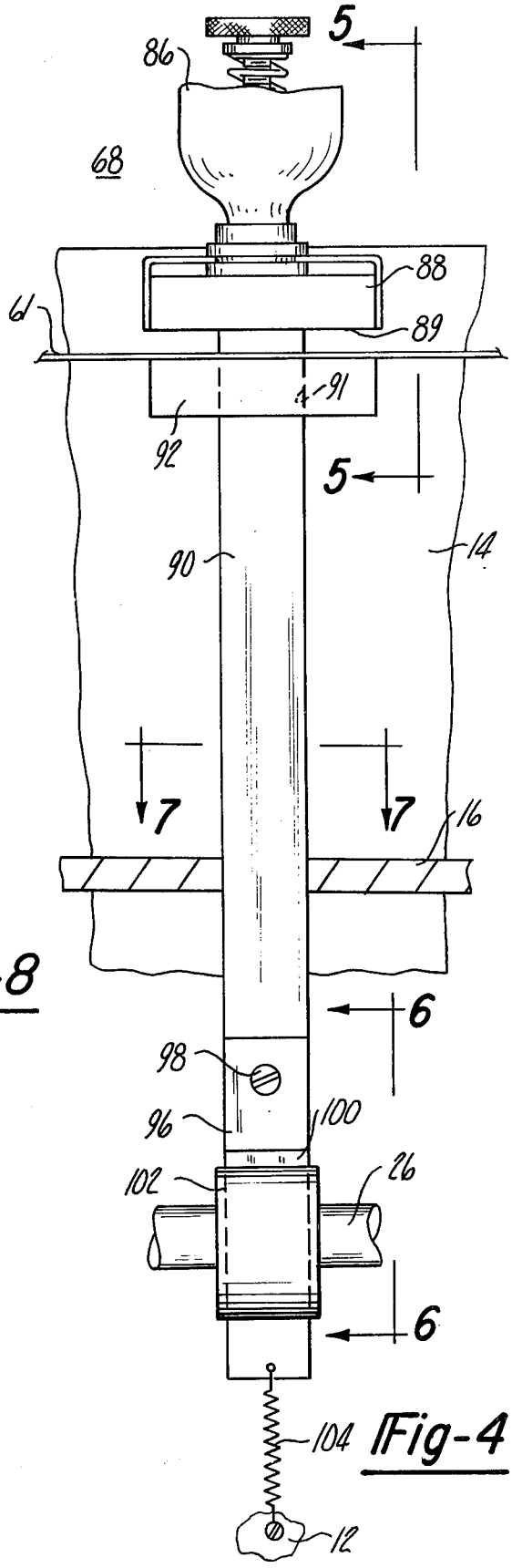
FIG. 4 is a fragmentary plan view illustrating one component of the packaging apparatus of the present invention and enlarged for clarity.
Figure 6:
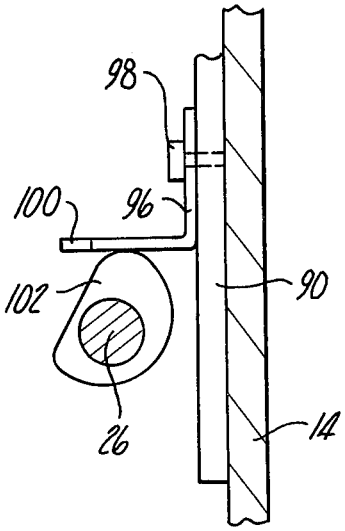
FIG. 6 is a fragmentary partial sectional view taken substantially along lines 6—6 in FIG. 4.

At the lower end of the bar 90, as best shown in FIGS. 4 and 6, a right angle member 96 is secured to the bar 90 by a bolt 98 so that one leg 100 of the right angle member 96 extends over a cam 102 secured to the shaft 26. Upon rotation of the shaft 26, the bar 90 vertically reciprocates whereby in its lowest position, the stencil pad 88 contacts the conveyor strip 61 and imprints the indicia upon the conveyor strip 61. In addition, in order to insure continued contact of the leg 100 of the right angle member 96 with the cam 102, preferably, a spring 104 (FIG. 4) is coupled at one end to the bottom of the bar 90 and at its other end to the housing 12.

Figure 5:
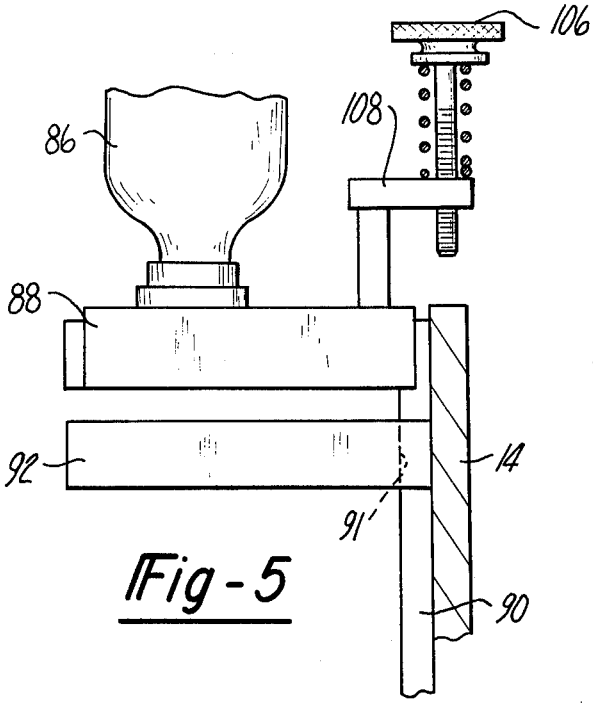
FIG. 5 is a fragmentary plan view taken substantially along line 5—5 in FIG. 4.

With reference particularly to FIG. 5, in order to limit the downward travel of the bar 90, preferably a thumb screw 106 is threadably mounted in a support member 108 attached to the stencil pad 88 so that the thumb screw 106 is in vertical alignment and upwardly spaced from the back 14 of the housing 12. Thus, with the bar 90 in its downward position, the thumb screw 106 abuts against the top of the back 14 and limits the downward travel of the bar 90 with the attached stencil pad 88. Rotation of the thumb screw 106, of course, adjusts the downward travel of the bar 90.

Figure 8:
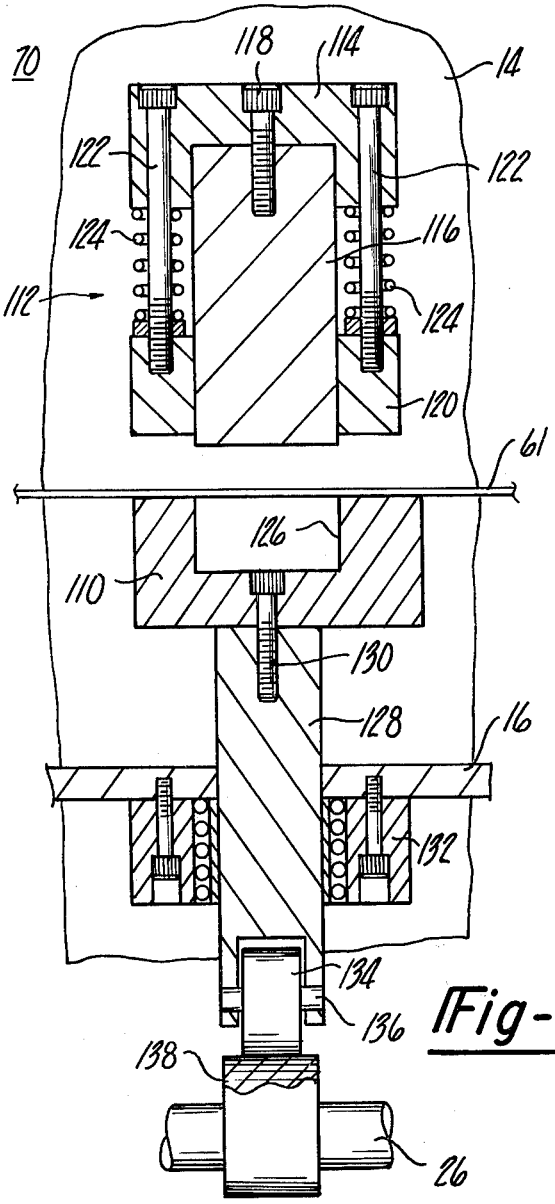
FIG. 8 is a fragmentary cross-sectional view illustrating another component of the packaging apparatus of the present invention and enlarged for clarity.
Figure 7:
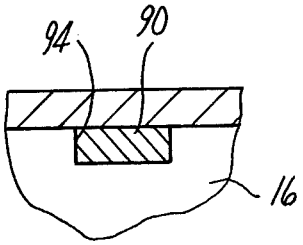
FIG. 7 is a fragmentary partial sectional view taken substantially along line 7—7 in FIG. 4.

With reference now particularly to FIG. 8, the indenting means 70 is thereshown in greater detail and includes a punch member 110 which is vertically movable into a die member 112 to thereby form an indentation in the conveyor strip 61.

The die member 112 includes an upper support 114 secured to the housing back 14 by means not shown. A cylindrical element 116 secured to the support 114 by a bolt 118 so that the cylindrical element 116 extends vertically downwardly from the support 114. An annular member 120 is slidably mounted around the element 116. A plurality of bolts 122 vertically slidably extend through the support 114 and threadably engage the annular member 120 at their lower end. The bolts 122 limit the downward travel of the annular member 120 along the element 116 and helical springs 124 disposed around the bolts 122 are in a state of compression and urge the annular member 120 downwardly.

The punch 110 includes a cylindrical recess 126 in registry with the cylindrical element 116 and adapted to receive the element 116 therein. The punch 110 is carried by a vertical rod 128 and vertically slidably extends through the shelf 16 and a bearing assembly 132.

A wheel 134 is rotatably mounted on an axle 136 at the lower end of the rod 128. The wheel 134 rides along a cam 138 secured to the shaft 26 which is substantially identical to the cam member 102 shown in FIG. 6 so that rotation of the shaft 26 vertically reciprocates the rod 128 with the attached punch 110.

As the shaft 26 rotates and the cam 138 drives the rod 128 upwardly, the cylindrical element 116 is received within the recess 126 while the punch 110 contacts and shifts the annular member 120 upwardly against the force of the springs 124. In this manner the conveyor strip 61 is trapped between the punch 110 and the annular member 120 while the cylindrical element 16 forms the indentation 72 in the conveyor strip 61.

With reference now to FIGS. 9 and 10 a simplified indentation means 70′ is thereshown and includes a punch 110 carried by the rod 128 in the aforementioned fashion. The die 112′, however, is of solid construction and secured to the back 14 of the housing 12. The die 112′ includes a circular protrusion 140 which registers with a like formed recess 142 in the punch 110 so that as the punch 110 moves upwardly into the die 112′, the indentation 72 is formed in the conveyor strip 61.

With reference to FIGS. 1 and 3, the loading area 74 comprises merely a space between the indenting means 70 and the sealing means 78. As has been previously mentioned, the articles 76 are preferably individually or manually placed into the indentations 72 formed in the conveyor strip 61. However, in order to facilitiate the loading operation, preferably a tray 144 is secured to the table 16 of a housing 12 adjacent to and slightly above the conveyor strip 61. The articles 76 can be placed on the tray 144 and manually pushed off or lifted from the tray 144 and into the indentations 72 in the conveyor strip 61.

Figure 12:
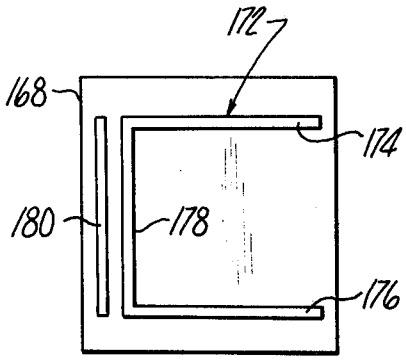
FIG. 12 is a plan view taken substantially along line 12—12 in FIG. 11.
Figure 11:
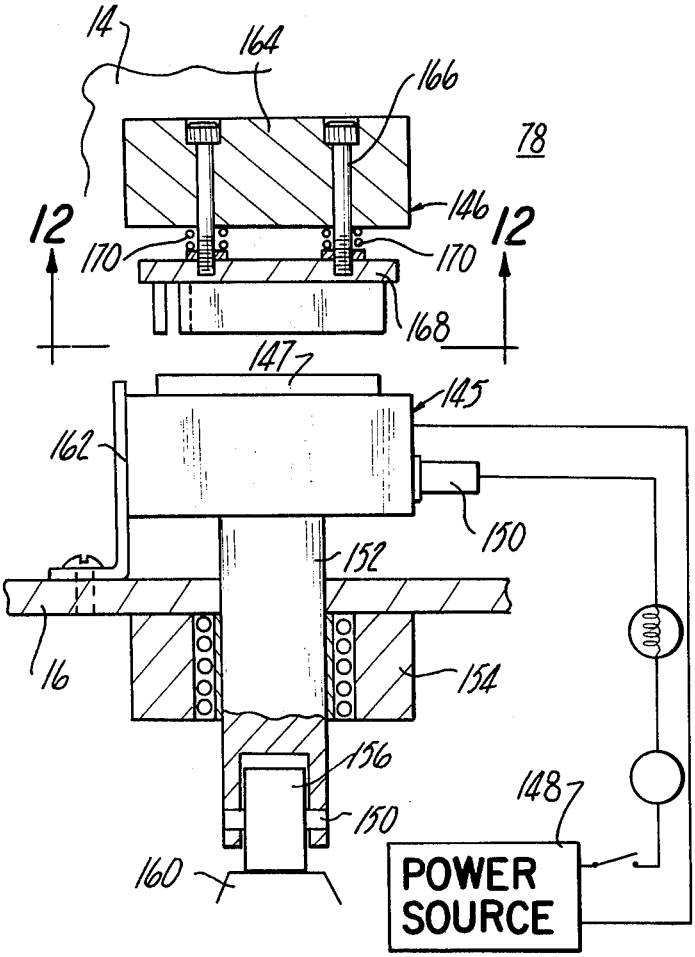
FIG. 11 is a fragmentary partial sectional view showing yet another component of the packaging apparatus of the present invention and enlarged for clarity.

With reference now to FIGS. 11 and 12, the sealing means 78 is thereshown in greater detail and comprises a lower heated platen 145 and an upper heat sink 146.

The heated platen 145 includes a relatively flat heating element 147 which is connected to a power source 148. A thermostat 140 controls the temperature of the heating element 147. Like the punch 110 illustrated in FIG. 8, the platen 144 is carried by a rod 152 which vertically slidably extends through the table 16 and a bearing assembly 154. A wheel 156 is rotatably mounted on an axle 158 at the lower end of the rod 152 and rides along a cam 160 secured to the shaft 26 so that rotation of the shaft 26 vertically reciprocates the platen 144. In addition, a right angle guide 162 is attached to the table 16 and abuts along one side of the platen 144 to prevent rotation of the platen 144 along the axis of the rod 152.

The heat sink 146 includes an upper support 164 which is fastened to the back 14 of the housing by means not shown. A number of bolts 166 extend vertically downwardly through the support 164 and threadably engage a seal forming member 168 at their lower end. The bolts 166 are slidably disposed through the support 164 and limit the lowermost position of the seal forming member 168. A helical spring 170 is disposed around each bolt 166 between the support 164 and the seal forming member 168 to urge the member 168 downwardly.

The seal forming member 168 is best shown in FIG. 12 and includes a U-shaped flange 172 having spaced and parallel legs 174 and 176 which register with the longitudinal edges of the conveyor strip 61 and a third leg 178 which extends perpendicularly between the ends of the legs 174 and 176 and laterally across the conveyor strip 61. A further flange 180 also forms a part of a member 168 and is in a spaced and parallel relationship with the leg 178 of the flange 172.

In operation, as the shaft 26 rotates, the cam 160 vertically reciprocates the heated platen 145 so that the conveyor strip 161 and the closure strip 64 are entrapped between the flat heating element 147 and the flanges 172 and 180 on the seal forming member 148. The heat from the heating element 147 fuses and seals the conveyor and closure strips 61 and 64 together in the shape of the flanges 172 and 180. In a manner which will become hereinafter more apparent, the sealing means 78 is positioned along the housing 12 so that one indentation 72 on the conveyor strip 61 is substantially centered within the flange 172 during a sealing operation. After the conveyor and closure strips 61 and 64 are advanced by the advancing means 80 which will be next described, on the next sealing operation the flange 180 closes the end of the package left opened by the right side of the flange 172 as shown in FIG. 12. In this fashion, the sealing means 78 seals the conveyor and closure strips 61 and 64, respectively, together in a closed loop (with two sequential sealing operations) wherein each closed loop encircles one of the indentations 73 formed by the indenting means 70.

With reference now to FIGS. 13–16, the advancing means 80 for incrementally advancing the joined conveyor and closure strips 61 and 64 is thereshown in greater detail. Referring first to FIGS. 13 and 14 a first spool 182 having an enlarged diameter portion 185 on each axial end is secured to an axle 183 which in turn is rotatably mounted to the housing 12 by bearings 184 and 186. The axis of rotation of the spool 182 is parallel to the plane but perpendicular to the longitudinal axis of the shelf 16.

An upper spool 188 of substantially the same axial length as the lower spool 182 includes an enlarged diameter portion 189 at each axial end. The spool 188 is preferably constructed of hard rubber and is rotatably mounted on axle 190 so that the axes of the spools 182 and 188 are in a spaced and parallel relationship.

The enlarged diameter portions 185 and 189 of the spools 182 and 188, respectively, are adapted to abut against each other. The longitudinal edges of the joined closure and conveyor strips 64 and 61, respectively, are clampingly received between the portions 185 and 189 of the spools 182 and 188 so that rotation of the spool 182 longitudinally advances the joined strips 61 and 64. In addition, as best shown in FIG. 13, the axle 190 of the upper spool 188 is attached to one end of a lever 192 which is releasably locked at its other end by a bolt 194 to the housing back 16. Thus, the tension between the portions 185 and 189 of the spools 188 and 182 can be adjusted by loosening the bolt 194, shifting the position of the upper spool 188 and thereafter tightening the bolt 194 into the housing back 16.

Figure 15:
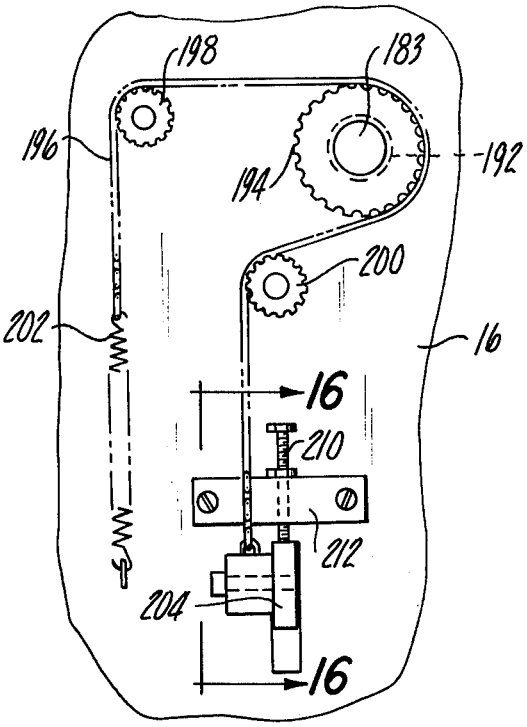
FIG. 15 is a fragmentary plan view illustrating the driving mechanism for the component illustrated in FIGS. 13 and 14.
Figure 16:
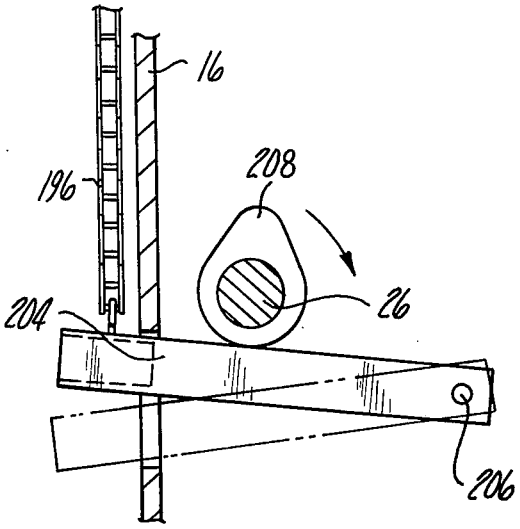
FIG. 16 is a fragmentary partial sectional view taken substantially along line 16—16 in FIG. 15 and enlarged and with parts removed for clarity.

The means for intermittently rotating the spool 182, and hence incrementally advancing the joined strips 61 and 64, are best illustrated in FIGS. 15 and 16. A one-way clutch 192 is disposed between a pinion 194 and the lower spool axle 183 so that the pinion 194 forms the drive member while the axle 183 forms the driven member of the clutch 192. The clutch 192 couples the pinion 194 to the axle in only one rotational direction so that clockwise rotation of the pinion 194 (FIG. 15) rotatably drives the spool axle 183 whereas counterclockwise rotation of the pinion 194 does not.

A length of chain 196 is coupled around the pinion 194 and also around sprockets 198 and 200. One end of the chain 196 is coupled to the housing back 16 via a spring 202 whereas the other end of the chain 196 is coupled to a lever 204.

The lever 204 is pivotally attached by a pin 206 at one end to the housing 12 so that as the lever 204 pivots about the pin 206, as shown in phantom line in FIG. 16. As the lever 204 pivots downwardly it also pulls the chain 196 downwardly thus rotating the one-way clutch 192 in a clockwise direction. As the lever 204 pivots upwardly, the one-way clutch 192 is rotated in a counterclockwise direction due to the action of the spring 202. In order to effect this pivotal action of the lever 204, a cam 208 is coupled to the rotating shaft 26 so that one rotation of the shaft 26 incrementally rotates the spool 182 and thus incrementally advances the joined conveyor and closure strips 61 and 64.

As shown in FIG. 15, a bolt 210 threadably engages a plate 212 secured to the back 16 of the housing 12. The bolt 210 is in alignment with the lever 204 so that the lower end of the bolt 210 abuts against the upper edge of the lever 204. Rotation of the bolt 210 controls the pivotal travel of the lever 204 and, hence, the amount of lineal advancement of the joined strips 61 and 64 per revolution of the shaft 26.

The cutting means 82, best illustrated in FIGS. 17 and 18, includes an upper blade support 211 and a lower member 212. The blade support 211 is secured to the housing shelf 16 by vertically extending bolts 214 which extend through apertures 216 formed in the blade support 211. A helical spring 218 is disposed around each bolt 214 between the shelf 16 and the blade support 211 and urges the blade support 211 upwardly away from the table 16. Nut members 220, however, threadably engage the upper ends of the bolts 214 and prevent separation of the blade support 211 from the bolts 214.

Preferably, a plate 222 is received within a recess 224 formed within the blade support 211 so that a cutting blade 226 can be sandwiched between the plate 222 and the support 211. Thumbscrews 228 extend through the plate 222 and threadably engage the support 211 in order to clampingly lock the blade 226 to the blade support 210 while permitting easy access to and replacement of the blade 226 when necessary. It should also be noted that the blade 226 shown in FIG.17 will perforate the joined strips 61 and 74 due to the notches 230 in the blade 226, but that a straight blade can easily be substituted for the perforating blade 226 illustrated in the drawing.

The member 212 is similar to the punch 110 illustrated in FIG. 8 in that the member 212 is carried on a vertically extending rod 232 which vertically slidably extends through the shelf 16 by a bearing assembly 234. A roller 236 is rotatably carried at the bottom end of the rod 232 and rides along a cam 238 secured to the shaft 26. As before, rotation of the shaft 26 vertically reciprocates the member 212 so that the member 212 alternately abuts against and is spaced away from the blade 226, as shown in FIG. 17. As should be apparent, the blade 226 cuts the joined conveyor and closure strips 61 and 64 as the member 212 abuts against the blade 226. The nuts 220 serve also as an adjustment means to insure that the blade 226 cuts the strips 61 and 64.

In order to insure that the roller 236 rides along the cam 238, a pair of bolts 240 slidably extend through the shelf 16 and threadably engage the bottom of the member 212. Helical springs 242 disposed around each bolt 240 between the bolt head 241 and the bottom of the table support 16 urge the member 212 downwardly and maintains the roller 236 in contact with the cam 238.

Still referring to FIG. 17, an arm 244 is preferably secured to the member 212 and extends outwardly and abuts against a pivotal arm 246 on a counter 248. The counter 248, actuated by the lever 246, counts each reciprocation of the member 212. Each reciprocation of the member 212, of course, is indicative that a cutting operation has occurred.

With reference now particularly to FIG. 2, the cams 138, 102, 160, and 238 are arranged rotationally on the shaft 26 so that the labeling, indenting, sealing, and cutting operations all occur substantially in synchronization with each other. Conversely, the operation of the advancing means 58 is precisely asynchronous with these other operations. In other words, when the spool 182 of the advancing means 58 is rotationally stopped, the labeling means 68, indenting means 70, sealing means 78, and the cutting means 82 all perform their respective operations on the conveyor strip 61 or the joined conveyor and closure strips 61 and 64. Conversely, these latter means are retracted away from the conveyor strip 61 or the joined conveyor and closure strips 61 and 64, while the advancing means 80 moves the joined strips 61 and 64 leftward (as viewed in FIG. 2) incrementally. This, of course, results in the formation of the packages 84 illustrated in FIGS. 19 and 20.

It will also be understood that the labeling means 68 is spaced a predetermined lineal distance away from the indenting means 70 so that the indicia 87 is substantially centered on each indentation 72. Similarly the sealing means 78 is linearly spaced from the indenting means so that each indentation 72 is substantially centered in the closed loop formed by the sealing means 78. Likewise the cutting means 82 is linearly spaced from the sealing means 78 so that the blade 226 perforates or severs (depending upon the type of blade 226) the joined closure and conveyor strips 64 and 61 between each of the closed loops formed by the sealing means 78.

A prime advantage of the packaging device of the present invention is that the present invention utilizes the conveyor strip 61 as part of the packaging material. As such, the necessity of the previously known separate conveyor system for moving the packaging material is totally eliminated.

Another prime advantage of the packaging device of the present is that the advancing means 80 simultaneously moves both the conveyor strip 61 and the closure strip 64. This construction thus eliminates the necessity of the previously known synchronization mechanisms between the feeding devices for the conveyor strip 61 and the closure strip 64.

A still further advantage of the article packaging device of the present invention is the elimination of the feeder for placing the articles into the indentations formed by the indenting means 70. By manually placing the small articles in the indentation in the conveyor strip 61, the previously known expense and failures of the feeder is totally eliminated.

A still further advantage of the packaging device of the present invention is that by use of the single shaft 26 with the attached cams, automatic synchronization of the working operations at each of the working stations 50–60 is insured.

Having thus described my invention, many modifications thereto will become apparent to those skilled in the art to which it pertains without deviating from the spirit of the invention as defined by the scope of the appended claims.

I claim:

1. In a machine for packaging items in sealed pockets of packages formed from a pair of strips of packaging material; means defining a continuous path of movement for one of the strips first in one direction and thereafter in a direction opposite said one direction, means disposed in the path for intermittently printing a label on one side of one of the strips when disposed for movement in said one direction, means located in the path for intermittently indenting said one strip at an opposite side thereof when disposed for movement in said opposite direction, said indenting means including a recessed punch member cooperating with an opposing die member for cold pressing spaced indentations in said one strip, means for directing the other of said strips in flat form to overlie said indented strip after the items to be packaged are loaded in said indentations, means adjacent said directing means for intermittently heat sealing said strips together along the periphery of said indentations to provide a strip of sealed packages, said sealing means including a heated platen cooperating with an opposing heat sink member, means for intermittently advancing said strip of packages along said path, and means for intermittently cutting said strip of packages between said indentations, said cutting means including a bearing block cooperating with an opposing blade member, said punch member, platen and bearing block being mounted for reciprocating movement into contact with their respective opposing members.

2. In the machine according to claim 1, wherein said opposing die, heat sink and blade members are each cushion mounted for yielding movement upon contact by their respective punch member, platen and bearing block.

3. In the machine according to claim 2, wherein said printing means includes a support member cooperating with an opposed stencil pad, said support member being mounted for reciprocating movement relative to said pad, and said support member, punch member, platen and bearing block being mounted for simultaneous reciprocating movement.

4. In the machine according to claim 3, including a rotatable cam shaft associated with said printing, indenting, sealing, advancing and cutting means, cam means on said shaft associated with said support member, punch member, platen and bearing block for effecting simultaneous reciprocating movement thereof upon each complete rotation of said cam shaft.

5. In the machine according to claim 4, wherein said advancing means includes a pair of opposed strip gripping spools means on one of said spools engageable with said cam shaft for effecting a gripping of said strip of packages upon movement of said support member, punch member, platen and bearing block away from their respective opposing members.

* * * * *